US010704231B1

(12) United States Patent
Iizuka et al.

(10) Patent No.: US 10,704,231 B1
(45) Date of Patent: Jul. 7, 2020

(54) FRONT LOADER AND WORK MACHINE

(71) Applicant: KUBOTA CORPORATION, Osaka (JP)

(72) Inventors: Hiroaki Iizuka, Jefferson, GA (US); Daniel Underwood, Jefferson, GA (US); Chad Reeves, Jefferson, GA (US); Patrick Penland, Jefferson, GA (US)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/271,042

(22) Filed: Feb. 8, 2019

(51) Int. Cl.

| | |
|---|---|
| ***E02F 9/22*** | (2006.01) |
| ***E02F 3/28*** | (2006.01) |
| ***E02F 3/34*** | (2006.01) |
| ***E02F 9/16*** | (2006.01) |
| ***E02F 3/36*** | (2006.01) |

(52) U.S. Cl.
CPC ..... *E02F 9/2275* (2013.01); *E02F 3/283* (2013.01); *E02F 3/34* (2013.01); *E02F 3/3695* (2013.01); *E02F 9/16* (2013.01); *E02F 9/2225* (2013.01); *E02F 9/2267* (2013.01); *E02F 9/2271* (2013.01)

(58) Field of Classification Search
USPC ..... 414/686
See application file for complete search history.

(56) References Cited

U.S. PATENT DOCUMENTS 8,666,609 B2 * 3/2014 Iida ..... E02F 3/96 37/348
2009/0230731 A1 * 9/2009 Sakamoto ..... B62D 21/186 296/204

FOREIGN PATENT DOCUMENTS

JP 2006-183405 A 7/2006

* cited by examiner

*Primary Examiner* — Ronald P Jarrett
(74) *Attorney, Agent, or Firm* — Greenblum & Bernstein, P.L.C.

(57) ABSTRACT

A front loader includes a boom to which a bucket or a working implement other than the bucket is attached, a boom cylinder to move the boom, a first control valve to supply an operation fluid to the boom cylinder, a supporting member supporting the boom on a front portion of a vehicle body of a work machine, an attachment frame extending backward from the supporting member. The attachment frame is attached to a side portion of the vehicle body. The front loader further includes a second control valve to supply the operation fluid to the working implement. The second control valve is attached to the attachment frame.

8 Claims, 14 Drawing Sheets

FRONT LOADER AND WORK MACHINE

BACKGROUND OF THE INVENTION

Field of the Invention

The present invention relates to a front loader and to a work machine having the front loader.

Description of Related Art

A front loader disclosed in Japanese Patent Application Publication No. 2006-183405 (referred to as Patent Document 1) is previously known.

The front loader disclosed in Patent Document 1 includes a left boom (arm), a right boom (arm), a coupling pipe for coupling the left boom to the right boom, and a bucket attached to a tip of the boom, and a dump cylinder for driving the bucket. The front loader includes a control valve for controlling the supply of operation fluid flowing to the working implement when the working implement other than the bucket is attached to the boom, and the control valve is attached to the coupling pipe.

SUMMARY OF THE INVENTION

Problems to be Solved by the Invention

However, since the control valve is attached to the coupling pipe located at the front portion of the front loader in the above-mentioned front loader, there may be a risk of affecting the function of the control valve because the earth or the loads falls on the control valve during the working or the rain water or the snow falls on the control valve.

In consideration of the above-mentioned problems, the present invention intends to provide a front loader capable of preventing the earth, the sand, the rain water, the snow and the like from affecting the function of control valve and to provide a work machine provided with the front loader.

Means of Solving the Problems

The present invention adopts the following technical means to achieve the above-mentioned intention.

A front loader includes a boom to which a bucket or a working implement other than the bucket is attached, a boom cylinder to move the boom, a first control valve to supply an operation fluid to the boom cylinder, a supporting member supporting the boom on a front portion of a vehicle body of a work machine, an attachment frame extending backward from the supporting member. The attachment frame is attached to a side portion of the vehicle body. The front loader further includes a second control valve to supply the operation fluid to the working implement. The second control valve is attached to the attachment frame.

Effects of the Invention

According to the above-described front loader, the control valve (second control valve) to control the supply of hydraulic fluid flowing to the working implement other than the bucket is attached to the attachment frame. The attachment frame is attached on the side portion of the vehicle body of the work machine and extends backward from the supporting member supporting the boom. Thus, the earth, the sand, and the loads can be prevented from falling on the control valve during the working, and the rain water and the snow can be prevented from falling on the control valve. In this manner, the earth, the rain water, the snow, and the like can be prevented from affecting the function of the control valve.

DESCRIPTION OF THE EMBODIMENTS

Hereinafter, an embodiment of the present invention will be described below with reference to the drawings as appropriate.

<Work Machine>

Figure 13:
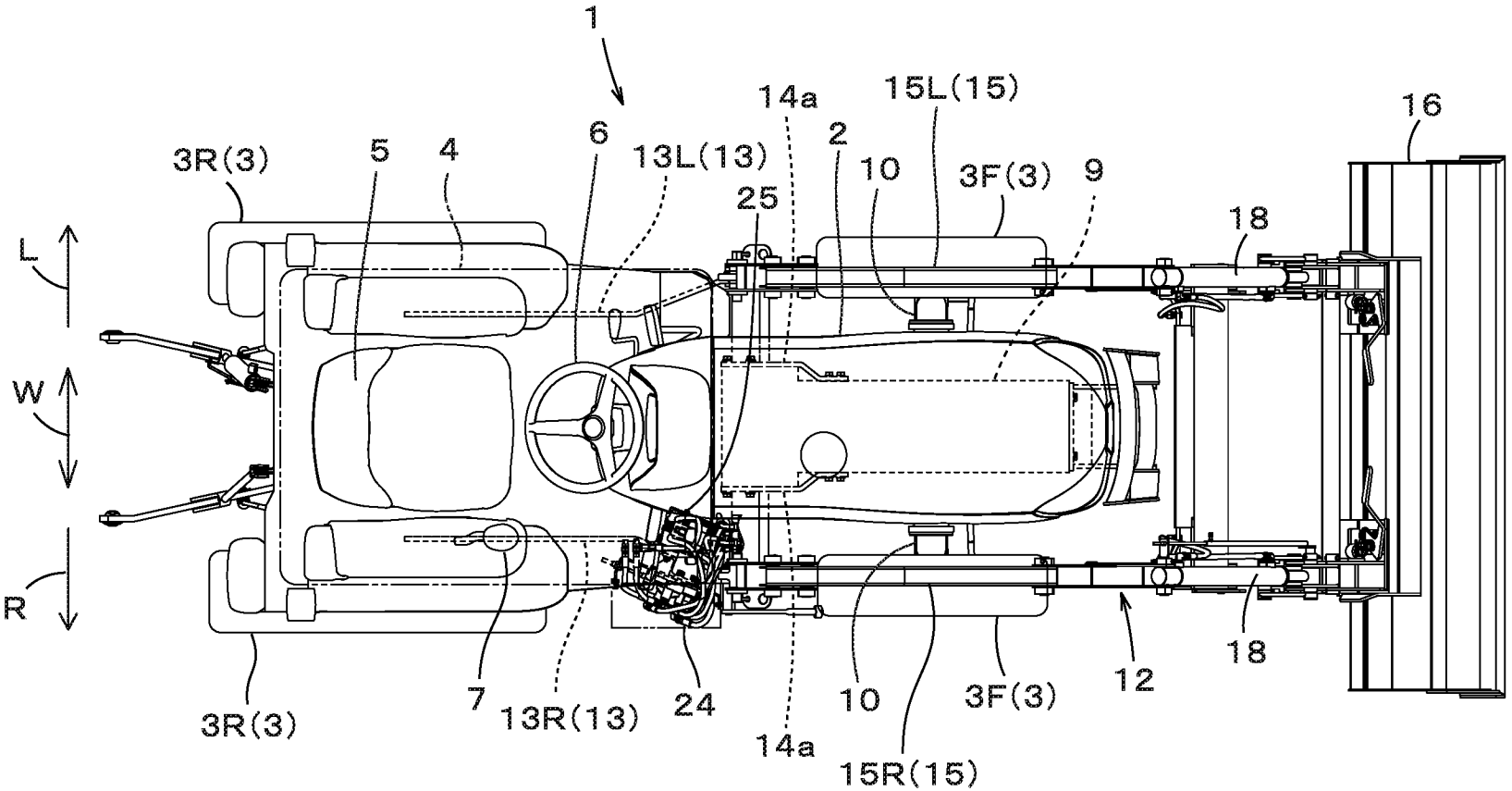
FIG. 13 is a plan view of the work machine according to the embodiment.
Figure 14:
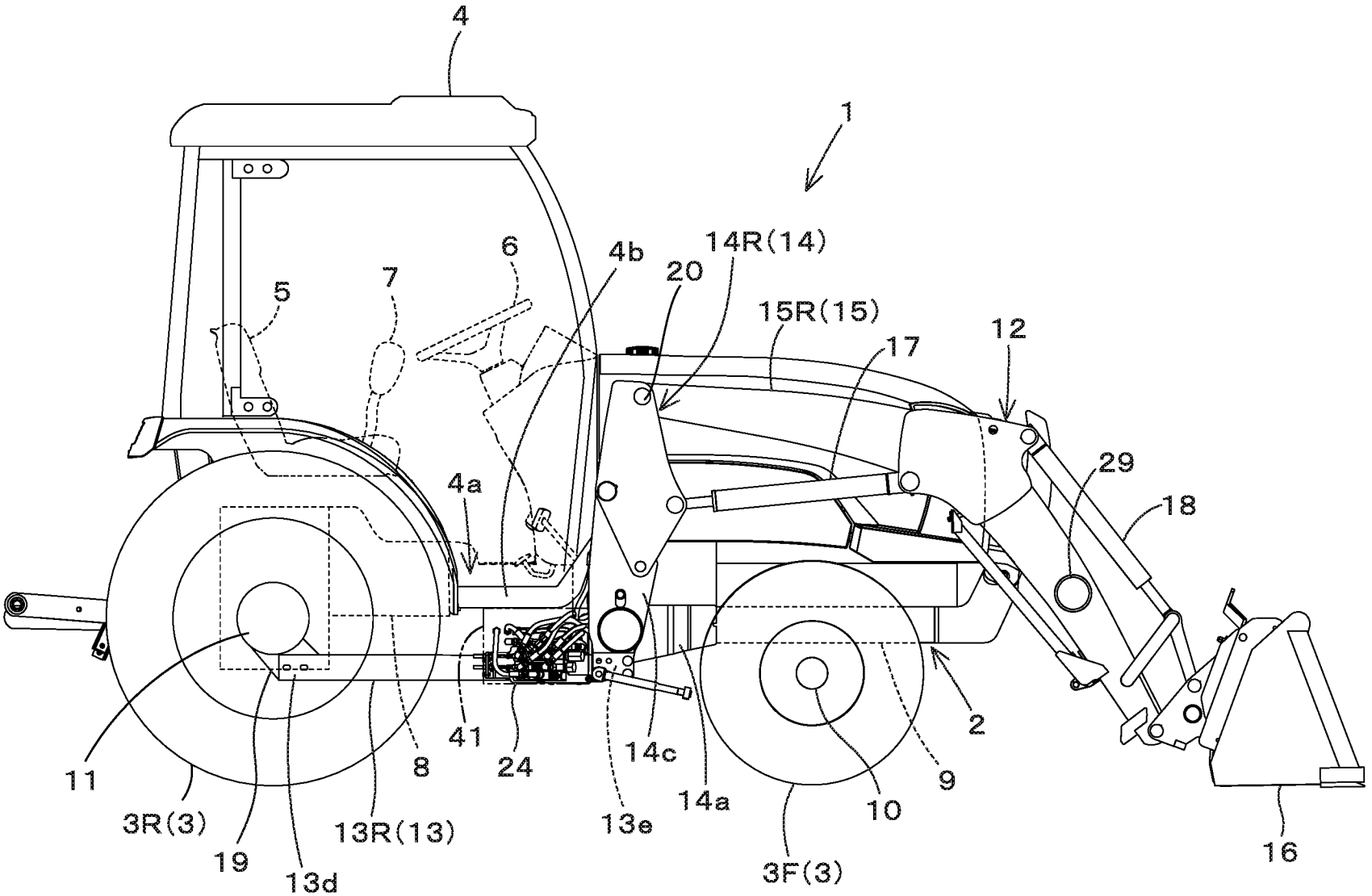
FIG. 14 is a side view of the work machine according to the embodiment.

FIG. 13 is a plan view showing a work machine 1 according to an embodiment of the present invention. FIG. 14 is a side view showing the work machine 1 according to the embodiment of the present invention. In the present embodiment, the work machine 1 is a tractor. Hereinafter, it is assumed that the work machine 1 is the tractor 1. The work machine 1 according to the embodiment of the present invention is not limited to the tractor. However, the work machine 1 may be another type of work machine (working vehicle).

In the following description, the front side (the right side in FIG. 13 and FIG. 14) of the operator seated on the operator seat 5 of the tractor (work machine) 1 is referred to as the front. The rear side (the left side in FIG. 13 and FIG. 14) of the operator is referred to as the rear. The left side (the direction of the arrowed line L in FIG. 13) of the operator is referred to as the left. And, the right side (the direction of the arrowed line R in FIG. 13) of the operator is referred to as the right.

In addition, the horizontal direction (the direction of the arrowed line W in FIG. 13), which is a direction orthogonal to the front-rear direction of the work machine 1, will be described as the machine width direction.

Further, a direction corresponding to the machine width direction and separating away from the center of the work machine in the machine width direction will be described as a machine outward direction. And, another direction corresponding to the machine width direction and approaching the center of the work machine in the machine width direction will be described as a machine inward direction.

The tractor 1 includes a vehicle body 2 and a traveling device 3.

A cabin 4 is mounted on the vehicle body 2. An operator seat 5 is provided inside the cabin 4. A steering wheel 6 is arranged in front of the operator seat 5. An operation lever 7 is arranged on the side of the operator seat 5.

An engine (not shown in the drawings) is mounted on the front portion of the vehicle body 2. A clutch housing, a transmission case 8, and the like are provided on the rear portion of the vehicle body 2. The traveling device 3 has a front wheel 3F provided on the front portion of the vehicle body 2 and a rear wheel 3R provided on the rear portion of the vehicle body 2.

The vehicle body 2 has a front axle frame 9 fixed to the underside of the engine. The front axle frame 9 supports the front axle case 10. The front axle case 10 supports the axle of the front wheel 3F. In addition, the vehicle body 2 has a rear axle case 11 fixed to a rear portion of the transmission case 7. The rear axle case 11 supports the axle of the rear wheel 3R.

A front loader 12 is attached to the vehicle body 2. The front loader 12 is supported on the front portion of the vehicle body 2. The front loader 12 will be described below.

<Front Loader>

As shown in FIG. 1 to FIG. 4, the front loader 12 includes an attachment frame 13, a support body 14, a boom 15, a bucket 16, a boom cylinder 17, and a bucket cylinder 18.

Figure 2:
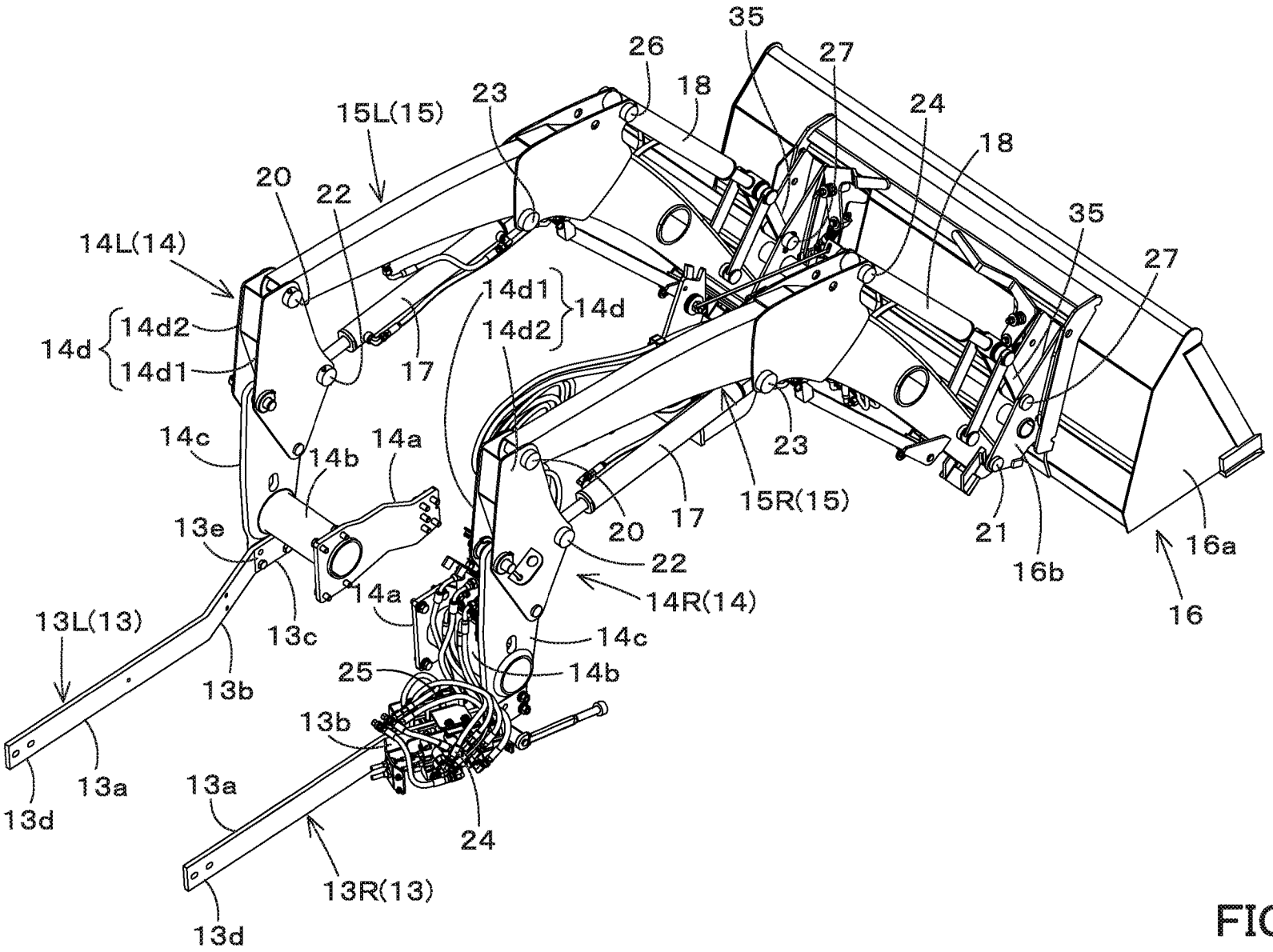
FIG. 2 is a perspective view of the front loader according to the embodiment.
Figure 3:
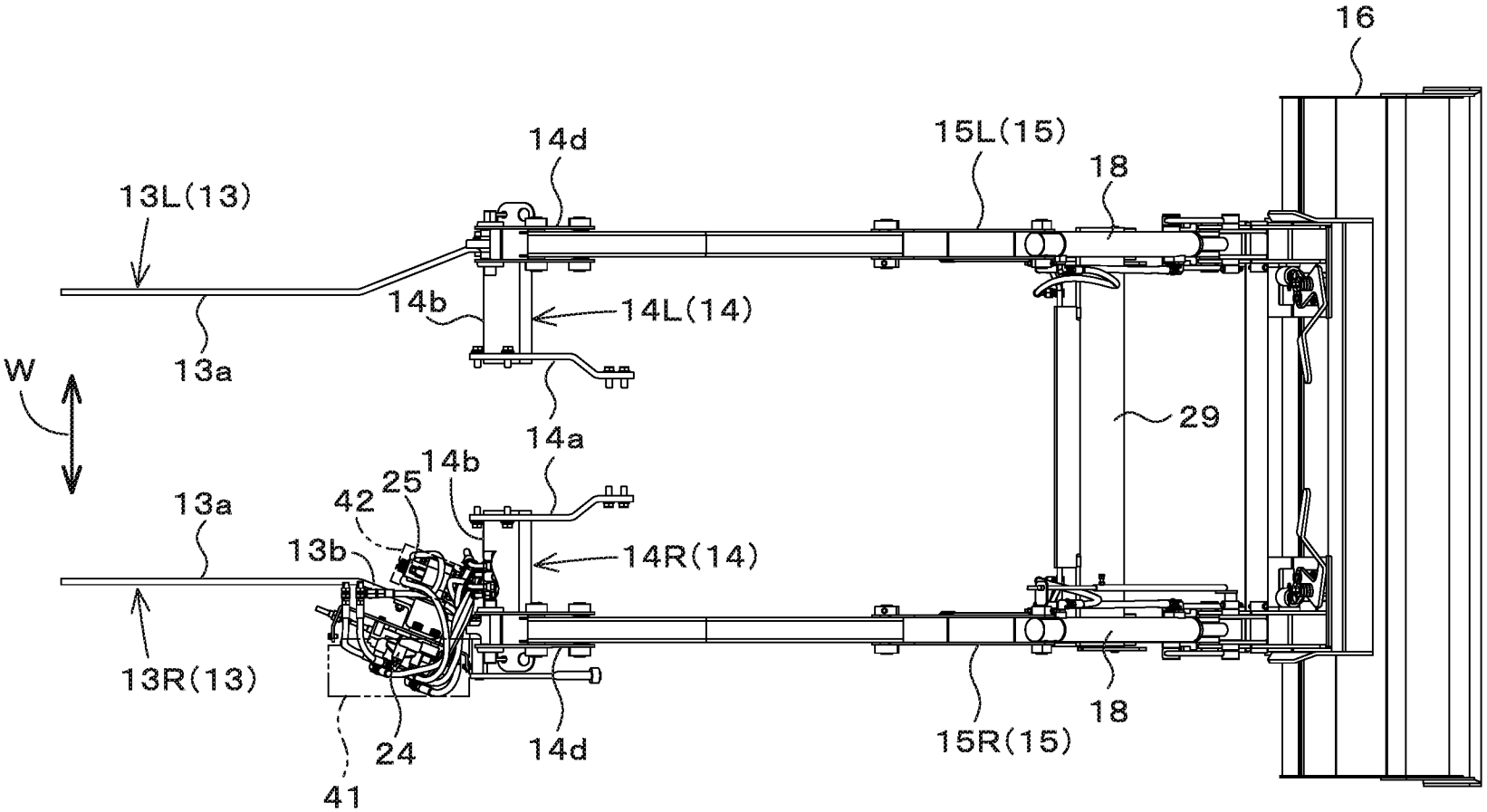
FIG. 3 is a plan view of the front loader according to the embodiment.
Figure 4:
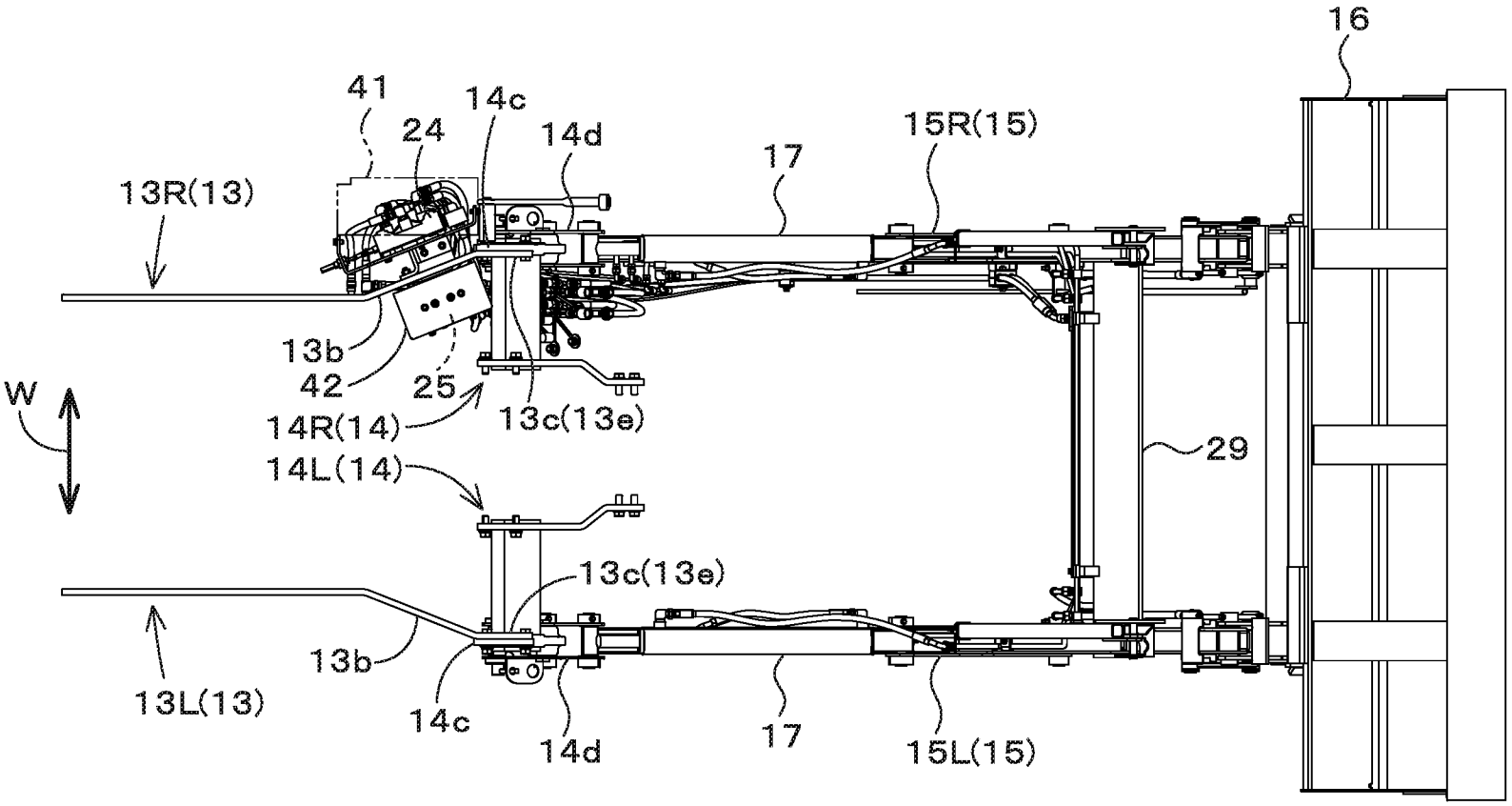
FIG. 4 is a bottom view of the front loader according to the embodiment.

As shown in FIG. 2 to FIG. 4, the attachment frame 13 has a left frame 13L and a right frame 13R. As shown in FIG. 13 and FIG. 14, the attachment frame 13 is attached to a side portion of the vehicle body 2 and extends in the front-rear direction.

In a state in which the attachment frame 13 is attached to the vehicle body 2 as shown in FIG. 13, the left frame 13L is arranged on the left side of the center of the vehicle body 2 in the width direction, and the right frame 13R is arranged on the right side of the center of the vehicle body 2 in the width direction. The left frame 13L and the right frame 13R are symmetrical with respect to the center of the vehicle body 2 in the width direction.

As shown in FIG. 14, FIG. 1 to FIG. 4, and the like, the attachment frame 13 extends backward from the support body 14 supporting the boom 15 at the front portion of the vehicle body 2. In addition, as shown in FIG. 13 and FIG. 14, the attachment frame 13 extends in the front-rear direction below the cabin 4.

As shown in FIG. 2 to FIG. 5, the attachment frame 13 (a left frame 13L and a right frame 13R) has a rear portion 13*a*, an intermediate portion 13*b*, and a front portion 13*c*. The rear portion 13*a* extends in the front-rear direction at the rear portion of the attachment frame 13.

The intermediate portion 13*b* is bent from the front end of the rear portion 13*a* and extends forward and in the machine outward direction. The front portion 13*c* extends forward from the front end of the intermediate portion 13*b*.

Figure 5:
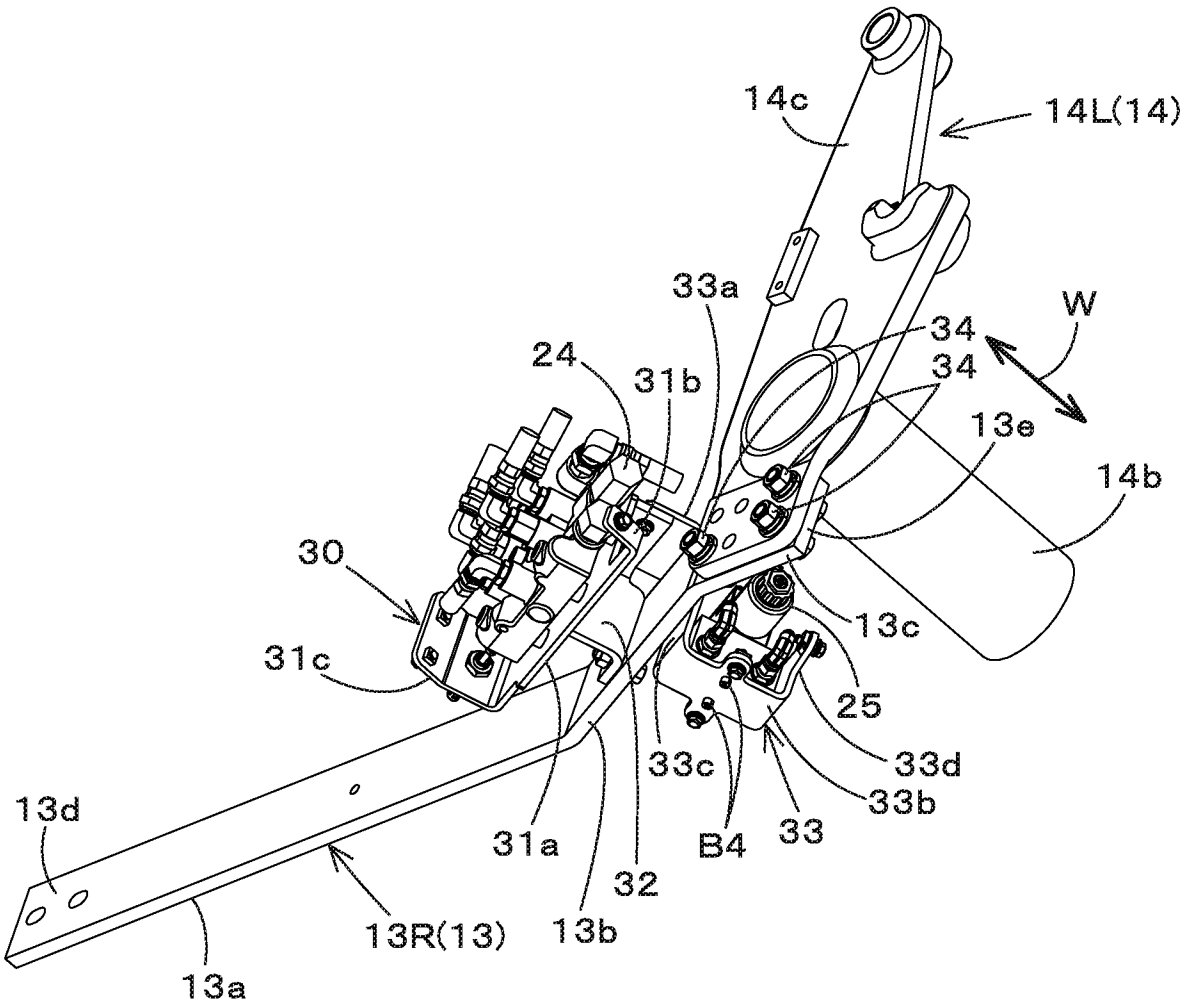
FIG. 5 is a view illustrating an attachment frame, a part of support body, a first control valve, a second control valve, and the like seen from a left-downward side according to the embodiment.

As shown in FIG. 2, FIG. 4, and FIG. 5, the attachment frame 13 (the left frame 13L and the right frame 13R) has a rear attachment portion 13*d* and a front attachment portion 13*e*.

The rear attachment portion 13*d* is provided at the rear portion 13*a* of the attachment frame 13. As shown in FIG. 13 and FIG. 14, the rear attachment portion 13*d* is arranged on the inner side of the rear wheel 3 R in the machine inward direction, and is overlapped with the rear wheel 3R in the front-rear direction. As shown in FIG. 14, the rear attachment portion 13*d* is attached to the rear axle case 11.

In particular, the rear attachment portion 13*d* is attached to the rear axle case 11 of the vehicle body 2 with the bracket 19 by a bolt or the like. However, the rear attachment portion 13*d* may be attached to another position of the rear portion of the vehicle body 2 (for example, the rear portion of the transmission case 8).

The front attachment portion 13*e* is provided in the front portion 13*c* of the attachment frame 13. A support member 14 is attached to the front attachment portion 13*e*. The front attachment portion 13*e* is arranged rearward of the front wheel 3F and forward of the rear wheel 3R.

As shown in FIG. 14, the support body 14 supports the boom 15 at the front portion of the vehicle body 2. The support body 14 is attached to the attachment frame 13 and supports the boom 15.

As shown in FIG. 2 to FIG. 4, the support body 14 has a left support body 14L and a right support body 14R. The support body 14 (the left support body 14L and the right support body 14R) has an attachment plate 14*a*, a support base 14*b*, a main frame 14*c*, and a side frame 14*d*.

As shown in FIG. 13, the attachment plate 14*a* is attached to the left side of the vehicle body 2, and another attachment plate 14*a* is attached to the right side of the vehicle body 2. The attachment plate 14*a* arranged on the left is attached to the left side of the front axle frame 9. The attachment plate 14*a* arranged on the right is attached to the right side of the front axle frame 9.

As shown in FIG. 2 to FIG. 4, the support base 14*b* protrudes from the attachment plate 14*a* in the machine outward direction. The support base 14*b* of the left support body 14L protrudes leftward from the attachment plate 14*a* arranged on the left. The support base 14*b* of the right support body 14R protrudes rightward from the attachment plate 14*a* arranged on the right.

As shown in FIG. 2 and the like, the main frame 14*c* is provided so as to extend upward from end portions of the left and right support bases 14*b* in the machine outward direction.

As shown in FIG. 4 and FIG. 5, the main frame 14*c* of the left support body 14L is attached to the front attachment portion 13*e* of the left frame 13L. As shown in FIG. 4, the main frame 14*c* of the right support body 14R is attached to the front attachment portion 13*e* of the right frame 13R. As shown in FIG. 5, the lower portion of the main frame 14*c* is attached to the front attachment portion 13*e* of the attachment frame 13 by the fastening tools 34 (the bolt and the nut).

Thus, the main frame 14*c* is configured to be attached to and detached from the front attachment portion 13*e* of the attachment frame 13. In this manner, the support body 14 can be attached to and detached from the attachment frame 13.

Figure 1:
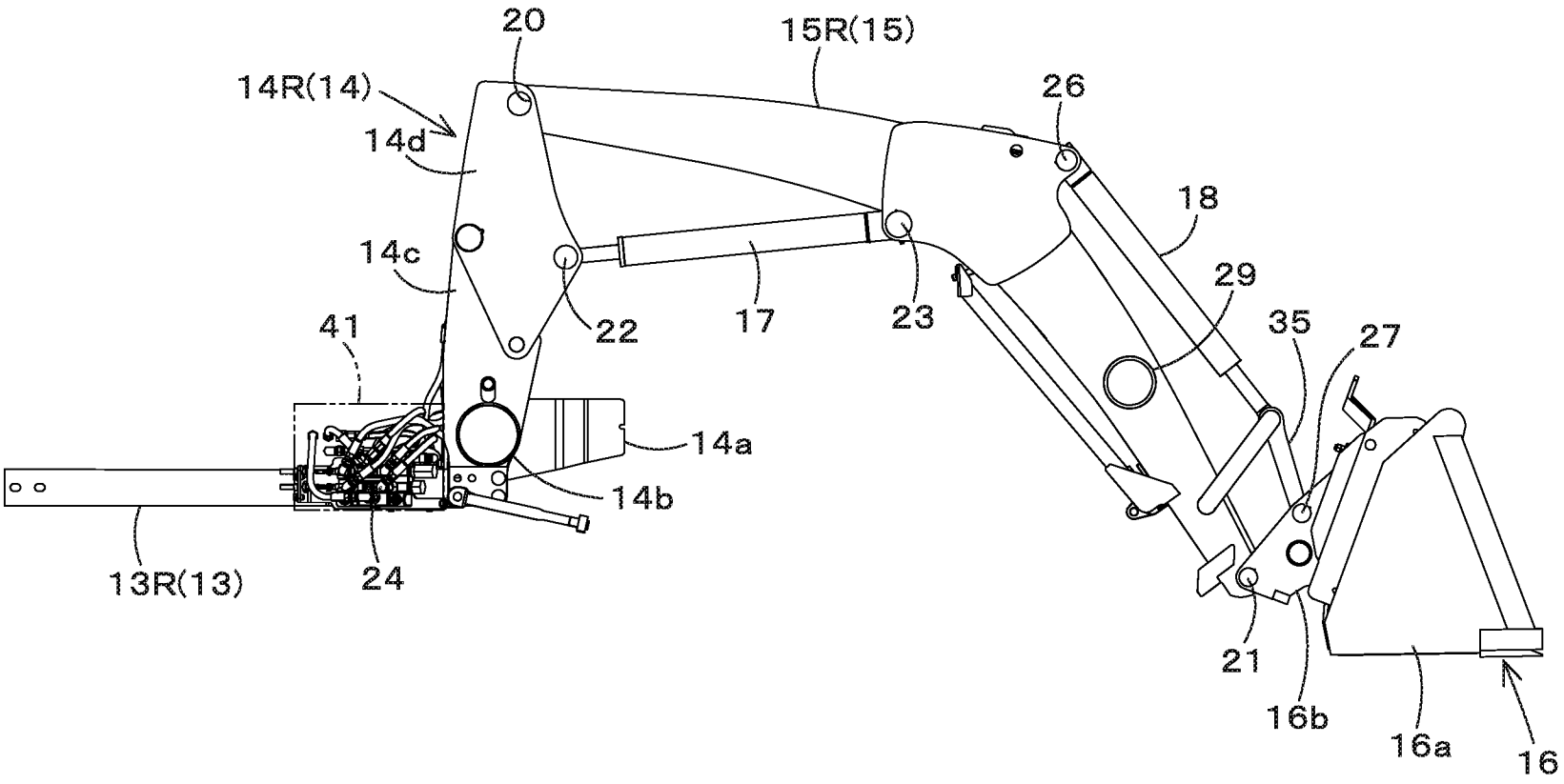
FIG. 1 is a side view of a front loader according to an embodiment of the present invention.

As shown in FIG. 1, FIG. 2, and the like, the side frame 14*d* is attached to the main frame 14*c*. The side frame 14*d* extends upward from the main frame 14*c*. The side frame 14*d* includes an inner side frame 14*d*1 and an outer side frame 14*d*2.

The inner side frame 14*d*1 is arranged on the machine inward side of the vehicle body. The outer side frame 14*d*2 is arranged on the machine outward side of the vehicle body. A first pivot 20 extending in the machine width direction is provided on the upper portion of the side frame 14*d*. The first pivot 20 penetrates the inner side frame 14*d*1 and the outer side frame 14*d*2 and extends in the machine width direction.

As shown in FIG. 2 to FIG. 4, the boom 15 has a left boom 15L and a right boom 15R.

As shown in FIG. 13, the left boom 15L is arranged on the left side of the vehicle body 2. The right boom 15R is arranged on the right side of the vehicle body 2. The left boom 15L is supported by the left support body 14L. The right boom 15R is supported by the right support body 14R.

As shown in FIG. 3, FIG. 4 and the like, the middle portion of the left boom 15L and the middle portion of the right boom 15R are coupled to each other by a coupling body 29.

As shown in FIG. 1 and FIG. 2, the base end sides of the boom 15 (the left boom 15L and the right boom 15R) are supported swingably about the first pivot 20 provided on the support body 14 (the side frame 14*d*). A second pivot 21 extending in the machine width direction is provided on the tip end side of the boom 15.

As shown in FIG. 1, FIG. 2, and FIG. 4, the boom cylinder 17 couples the side frame 14*d* to the boom 15. One end portion (tip end portion) of the boom cylinder 17 is attached to the side frame 14*d*.

In particular, one end portion of the boom cylinder 17 is rotatably supported with a first lateral shaft 22 at an intermediate portion of the side frame 14*d* in the vertical direction. The other end portion (base end portion) of the boom cylinder 17 is attached to the boom 15.

In particular, the other end portion of the boom cylinder 17 is rotatably supported with a second lateral shaft 23 at an intermediate portion of the boom 15 in the front-rear direction (a longitudinal direction). The boom cylinder 17 swings the boom 15.

The boom 15 swings upward around the first pivot 20 due to the extension of the boom cylinder 17 and swings downward about the first pivot 20 due to the shortening of the boom cylinder 17.

The boom cylinder 17 is controlled by a boom control valve 24A described later (see FIG. 11). The boom control valve 24A is attached to the front loader 12. The boom control valve 24A is manually operated by an operation tool such as the operation lever 7.

As shown in FIG. 1 and FIG. 2, the bucket 16 has a bucket bracket 16*a* and a bucket body 16*b*. The bucket bracket 16*a* is supported swingably around the second pivot 21.

The bucket body 16*b* is a portion for shoveling (accommodating) the earth and sand or the like, and is attached to the front portion of the bucket bracket 16*a*. The bucket bracket 16*a* and the bucket body 16*b* integrally rotate around the second pivot 21.

As shown in FIG. 1 to FIG. 3, the bucket cylinder 18 couples the bucket bracket 16*a* to the boom 15. One end portion (base end portion) of the bucket cylinder 18 is attached to the boom 15.

In particular, one end portion of the bucket cylinder 18 is rotatably supported with a third lateral shaft 26 at an intermediate portion of the boom 15 in the front-rear direction (the longitudinal direction).

The other end portion (tip end portion) of the bucket cylinder 18 is attached to the bucket bracket 16*a* with the linkage mechanism 35. In particular, the other end portion of the bucket cylinder 18 is rotatably supported on the bucket bracket 16*a* with a fourth lateral shaft 27 and the like.

The bucket cylinder 18 moves the bucket 16. The bucket 16 performs the shoveling operation about the second pivot 21 due to the extension of the bucket cylinder 18, and performs the dumping operation around the second pivot 21 due to the shortening of the bucket cylinder 18.

The bucket cylinder 18 is controlled by a bucket control valve 24B described later (see FIG. 11). The bucket control valve 24B is attached to the front loader 12. The bucket control valve 24B is manually operated by an operation tool such as the operation lever 7.

<Hydraulic Circuit>

Figure 11:
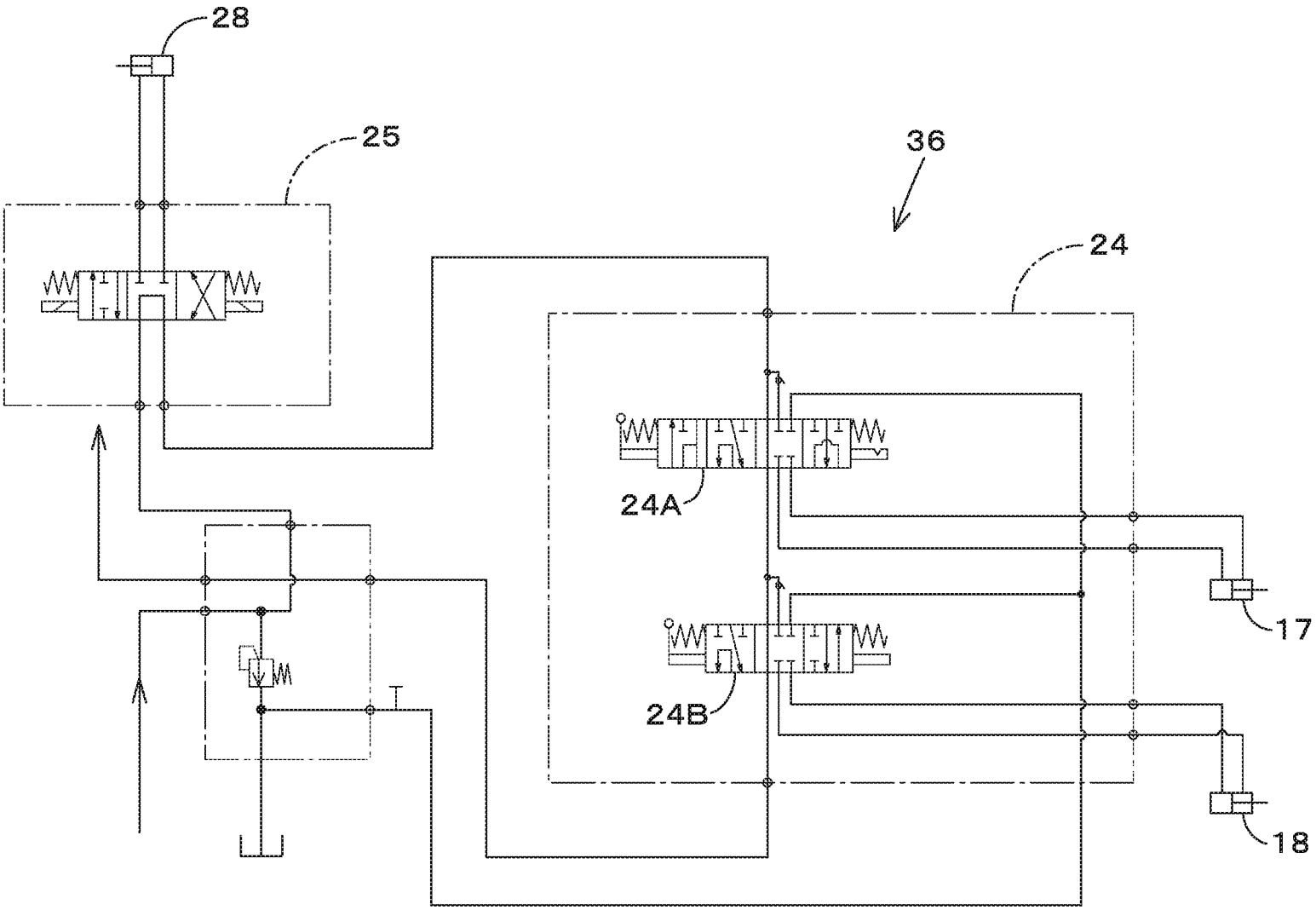
FIG. 11 is a circuit diagram illustrating a hydraulic circuit of a front loader according to the embodiment.

The front loader 12 is provided with a hydraulic circuit 36 (see FIG. 11). The hydraulic circuit 36 is a hydraulic circuit configured to control the boom cylinder 17, the bucket cylinder 18, and the hydraulic actuators (hydraulic cylinders and the like) 28 for working implements other than the bucket 16.

The hydraulic circuit 36 controls the boom cylinder 17, the bucket cylinder 18, and the hydraulic actuator 28 on the basis of the operation of the operation lever 7 and the like. The hydraulic circuit 36 has a first control valve 24 and a second control valve 25.

The first control valve 24 controls supply of the operation fluid flowing to the boom cylinder 17. In particular, the first control valve 24 includes a boom control valve 24A configured to control the supply of the operation fluid flowing to the boom cylinder 17.

The boom control valve 24A supplies the operation fluid to the boom cylinder 17 in accordance with the operation of the operation tool such as the operation lever 7, and moves the boom 15 upward and downward.

In the present embodiment, the first control valve 24 is a valve unit including the boom control valve 24A and the bucket control valve 24B. The bucket control valve 24B controls the supply of the operation fluid flowing to the bucket cylinder 18.

That is, the first control valve 24 controls the supply of the operation fluid flowing to the boom cylinder 17 and the bucket cylinder 18. The bucket control valve 24B supplies the operation fluid to the bucket cylinder 18 in accordance with the operation of the operation tool such as the operation lever 7, and allows the bucket 16 to perform the shoveling operation and the dumping operation.

The second control valve 25 controls the supply of the operation fluid flowing to the hydraulic actuator 28 (see FIG. 11) for the working implement other than the bucket 16.

Instead of or in addition to the bucket 16, the working implement is attached to the boom 15 and includes the hydraulic actuator 28 configured to be driven by a hydraulic pressure. Examples of the working implement include the roll grab (the bale grab), the silage grab, the grapple fork, the mania fork, the pallet fork, and the like. However, the working implement is not limited thereto.

The second control valve 25 supplies the operation fluid to the hydraulic actuator 28 in accordance with the operation of the operation tool such as the operation lever 7, and thereby controls movement of the working implement.

<Attachment Structure of First Control Valve and Second Control Valve>

As shown in FIG. 2 to FIG. 5 and the like, the first control valve 24 is attached to the attachment frame 13. The second control valve 25 is attached to the attachment frame 13. That is, the first control valve 24 and the second control valve 25 are attached to the attachment frame 13.

In the present embodiment, the first control valve 24 and the second control valve 25 are attached to the right frame 13R. However, the first control valve 24 and the second control valve 25 may be attached to the left frame 13L.

In the case where the first control valve 24 and the second control valve 25 are attached to the left frame 13L, the positions of the first control valve 24 and the second control valve 25 are reversely determined as compared with the case where the first control valve 24 and the second control valve 25 are attached to the right frame 13R.

As shown in FIG. 3 to FIG. 7, the first control valve 24 and the second control valve 25 are arranged (on both sides of the attachment frame 13 in the machine width direction W) with the attachment frame 13 (the right frame 13 R) sandwiched therebetween in the width direction (the machine width direction W) of the vehicle body 2.

In particular, the first control valve 24 is arranged on the outer side (the right side) of the attachment frame 13 (the right frame 13R) in the machine width direction. The second control valve 25 is arranged on the inner side (the left side) of the attachment frame 13 (the right frame 13R) in the machine width direction.

Although not shown in the drawings, the arrangements of the first control valve 24 and the second control valve 25 may be reversed. That is, the first control valve 24 may be arranged on the inner side (inward of the vehicle body) of the attachment frame 13 in the machine width direction, and the second control valve 25 may be arranged on the outer side (outward of the vehicle body) of the attachment frame 13 in the machine width direction.

As shown in FIG. 5 to FIG. 10, the first control valve 24 is attached to the attachment frame 13 with the first attachment member 30. The first attachment member 30 is arranged (on the machine outward side) outward from the attachment frame 13 in the machine width direction. In the present embodiment, the first attachment member 30 is arranged on the right side of the right frame 13R.

Figure 9:
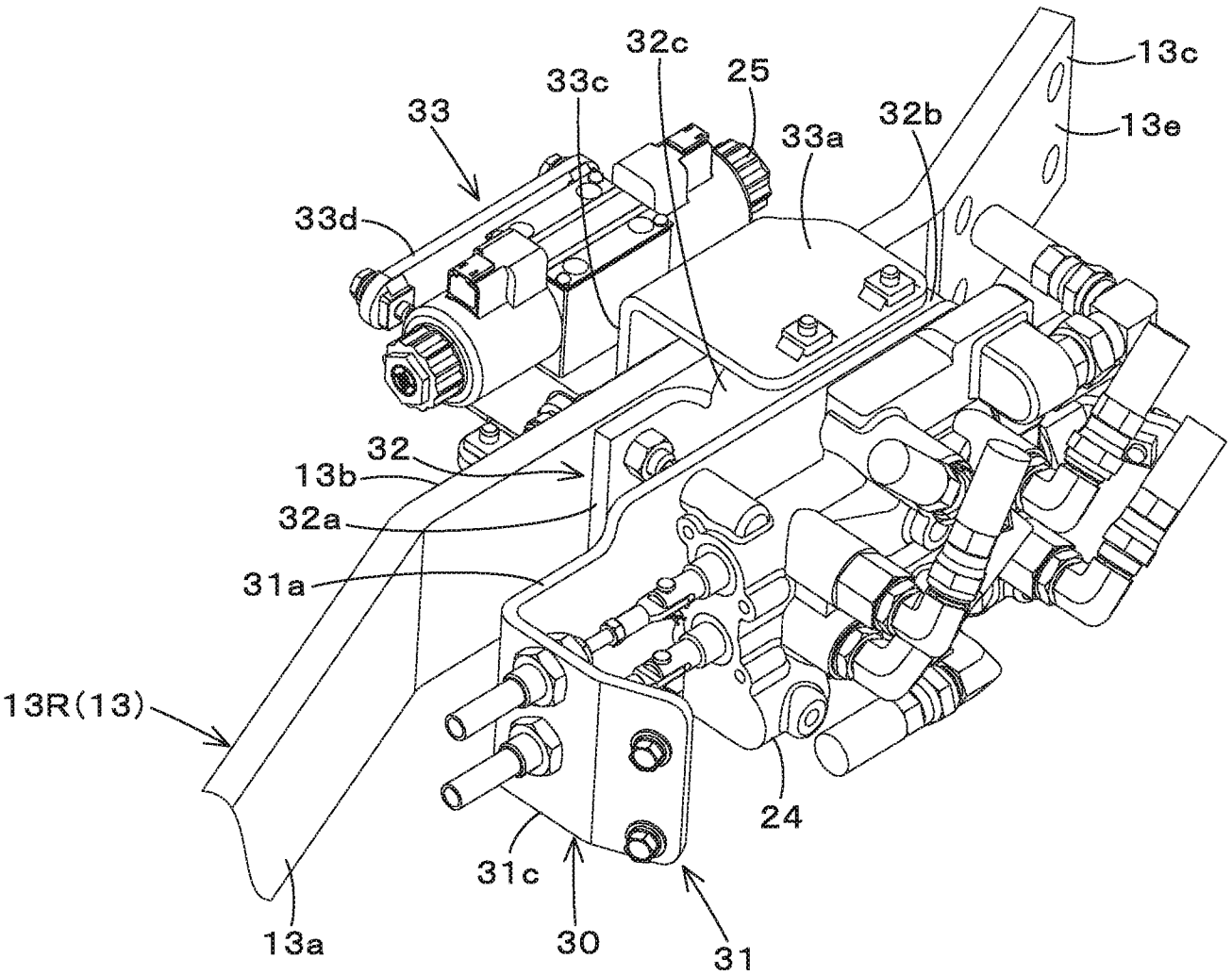
FIG. 9 is a view illustrating the attachment frame, the first attaching member, the second attaching member, the first control valve, and the second control valve seen from a right-upward side according to the embodiment.
Figure 10:
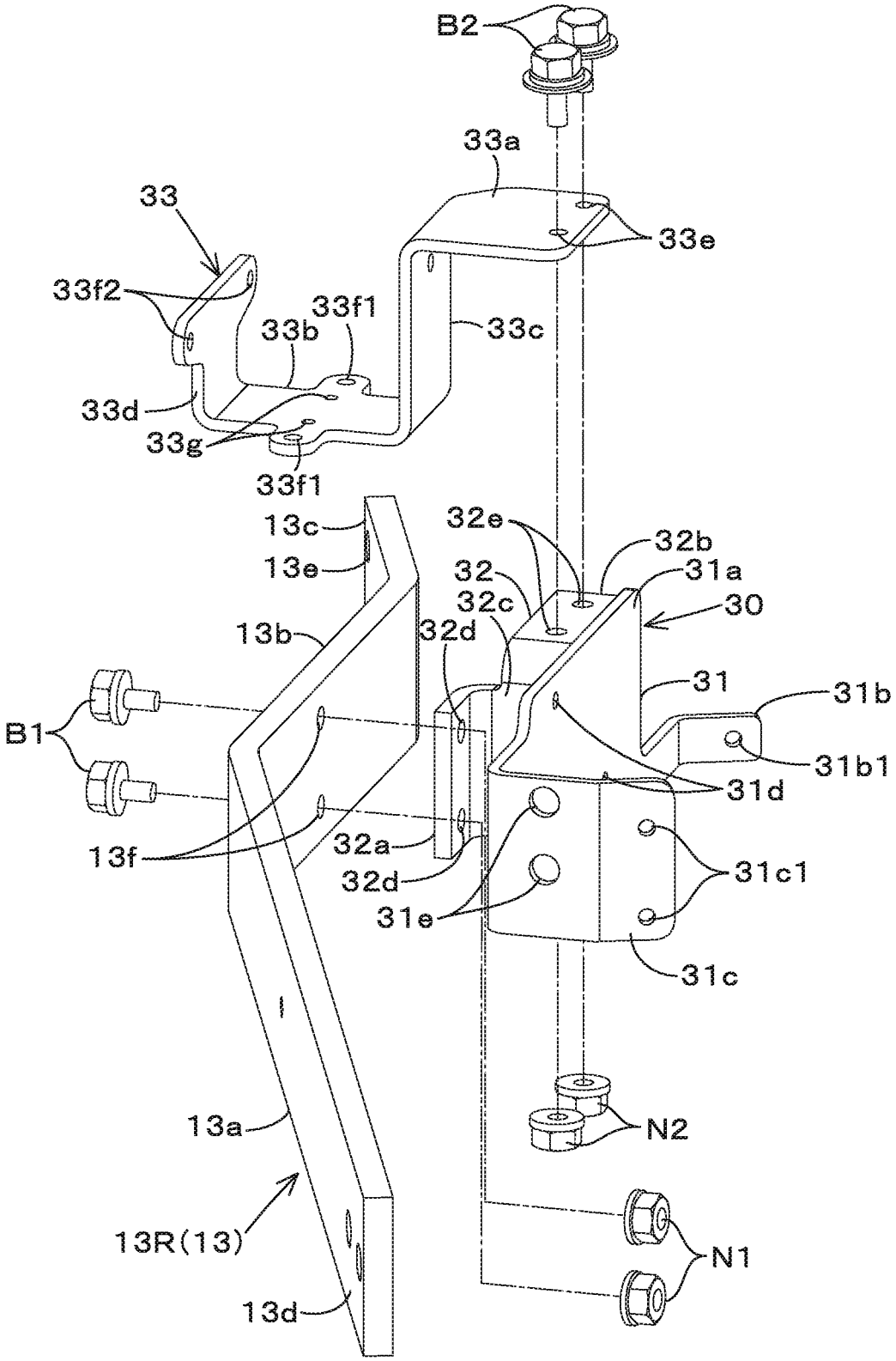
FIG. 10 is an exploded perspective view illustrating a structure to attach the first attaching member and the second attaching member to the attachment frame according to the embodiment.

As shown in FIG. 9 and FIG. 10, the first attachment member 30 has a first portion 31 and a second portion 32. The first portion 31 and the second portion 32 are connected to each other by the welding or the like, and thus are integrally formed.

The first portion 31 is a portion that supports the first control valve 24. The second portion 32 is a portion attached to the attachment frame 13 and supporting the second attachment member 33 described later.

As shown in FIG. 10 and the like, the first portion 31 has a first side plate portion 31*a*, a front plate portion 31*b*, and a rear plate portion 31*c*. The first side plate portion 31*a*, the front plate portion 31*b*, and the rear plate portion 31*c* are integrally formed by bending a single plate.

The first side plate portion 31*a* extends in the front-rear direction in parallel to the intermediate portion 13*b* of the attachment frame 13 (the right frame 13R). One side (the left side) of the first side plate portion 31*a* faces the attachment frame 13 (the right frame 13R) side, and the other side (the right side) faces the opposite side to the attachment frame 13 (the right frame 13R).

The front plate portion 31*b* extends in the machine outward direction (rightward) from the front end of the first side plate portion 31*a*. The rear plate portion 31*c* extends in the machine outward direction (rightward) from the rear end of the first side plate portion 31*a*. The front plate portion 31*b* and the rear plate portion 31*c* are provided with first attachment holes 31*b*1 and 33*c*1 for attachment of a first cover 41 described below.

Figure 8:
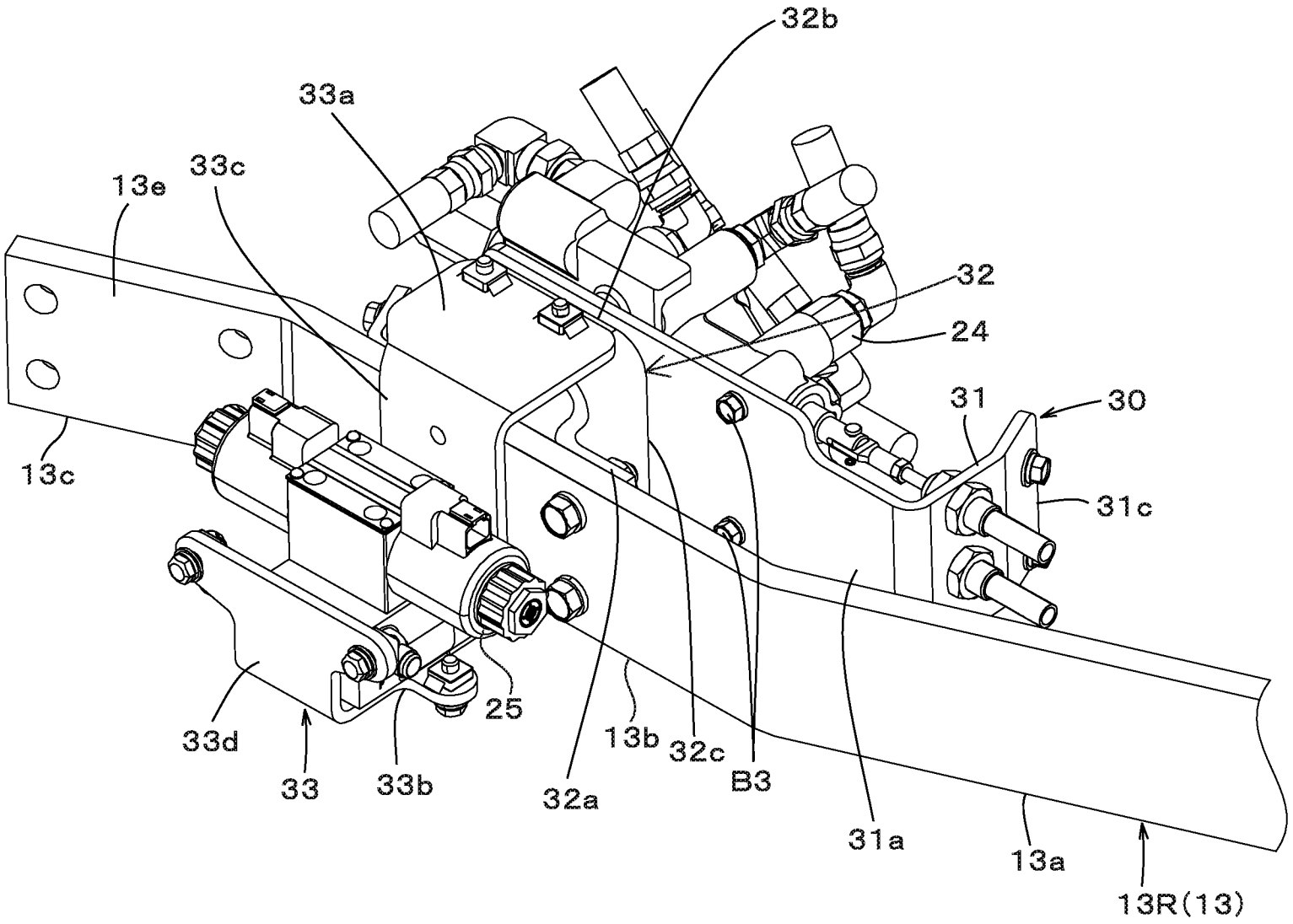
FIG. 8 is a view illustrating the attachment frame, a first attaching member, a second attaching member, the first control valve, and the second control valve seen from a left-upward side according to the embodiment.

The first control valve 24 is attached to the other surface (the right surface) of the first side plate portion 31*a* by a bolt B3 (see FIG. 8). In this manner, the first control valve 24 is fixed to the first attachment member 30.

In particular, as shown in FIG. 10, a through hole 31*d* is formed in the first side plate portion 31*a*, and the first control valve 24 is fixed to the first attachment member 30 by the bolt B3 (see FIG. 8) inserted through the through hole 31*d*.

A through hole 31*e* is formed in the rear plate portion 31*c*. A hydraulic hose is inserted through the through hole 31*e*, and the hydraulic hose couples the first control valve 24 to the pilot valve connected to the lower portion of the operation lever 7.

As shown in FIG. 9, FIG. 10, and the like, the second portion 32 has a second side plate portion 32*a*, an upper plate portion 32*b*, and a connecting plate portion 32*c*. The second side plate portion 32*a*, the upper plate portion 32*b*, and the connecting plate portion 32*c* are integrally formed by bending a single plate.

The second portion 32 is arranged between the first portion 31 and the attachment frame 13 (the right frame 13R). The upper plate portion 32*b* and the connecting plate portion 32*c* are connected to the surface on the machine inward side (to the left surface) of the first side plate portion 31*a* of the first portion 31 by the welding or the like.

The second side plate portion 32*a* is arranged parallel to the first side plate portion 31*a*. In addition, the second side plate portion 32*a* is arranged in parallel with the intermediate portion 13*b* of the attachment frame 13 (the right frame 13R).

One side (the left side) of the second side plate part 32*a* faces the attachment frame 13 (the right frame 13 R) side, and the other side (the right side) faces the side (the first side plate part 31*a* side) opposite to the attachment frame 13 (the right frame 13 R). One side (the left side) of the second side plate portion 32*a* is in contact with a surface (the right side) on the machine outward side of the attachment frame 13 (the right frame 13R).

As shown in FIG. 10, the second side plate portion 32*a* is attached to the right face (the right face of the intermediate portion 13*b*) of the attachment frame 13 by the attachment tool (the bolt B1 and the nut N1). In this manner, the first attachment member 30 is attached to the attachment frame 13.

In particular, a through hole 32*d* is formed in the second side plate portion 32*a*, and a through hole 13*f* is formed in the intermediate portion 13*b* of the attachment frame 13. The first attachment member 30 is attached to the attachment frame 13 by inserting the bolt B1 into the through hole 32*d* and the through hole 13*f* and screwing the nut N1 to the bolt B1.

As shown in FIG. 10 and the like, the upper plate portion 32*b* is arranged in front of the second side plate portion 32*a*. One surface (the upper surface) of the upper plate portion 32*b* faces upward, and the other surface (the lower surface) faces downward. A through hole 32*e* is formed in the upper plate portion 32*b*. The through hole 32*e* is provided for attaching the second attachment member 33 (described later) to the upper plate portion 32*b*.

The connecting plate portion 32*c* couples the second side plate portion 32*a* to the upper plate portion 32*b*. In particular, the connecting plate portion 32*c* couples the front end portion of the second side plate portion 32*a* to the rear end portion of the upper plate portion 32*b*. One side (the front surface) of the connection plate portion 32*c* faces forward, and the other face (the rear surface) faces backward.

The second side plate portion 32*a* and the connecting plate portion 32*c* are bent and connected to each other in an L-shape. The upper plate portion 32*b* and the connecting plate portion 32*c* are bent and connected to each other in an L-shape.

As shown in FIG. 8, FIG. 9, and the like, the second control valve 25 is attached to the first attachment member 30 with the second attachment member 33.

As shown in FIG. 10 and the like, the second attachment member 33 includes a first lateral plate portion 33*a*, a second lateral plate portion 33*b*, a first vertical plate portion 33*c*, and a second vertical plate portion 33*d*. The first lateral plate portion 33*a*, the second lateral plate portion 33*b*, the first vertical plate portion 33*c*, and the second vertical plate portion 33*d* are integrally formed by bending a single plate.

As shown in FIG. 8 and FIG. 9, the first lateral plate portion 33*a* is arranged above the attachment frame 13 (specifically, above the intermediate portion 13*b* of the right frame 13R), and extends striding over the attachment frame 13 in the machine width direction from the left side to the right side. One surface (the upper surface) of the first lateral plate portion 33*a* faces upward, and the other surface (the lower surface) faces downward. The first lateral plate portion 33*a* is attached to the upper surface of the upper plate portion 32*b*.

As shown in FIG. 10, a through hole 33*e* is formed in the first lateral plate portion 33*a*. The second attachment member 33 is attached to the upper plate portion 32*b* by inserting the bolt B2 through the through hole 33*e* and the through hole 32*e* formed in the upper plate portion 32*b* and by screwing the nut N2 with the bolt B2.

In this manner, the second attachment member 33 is attached to the first attachment member 30. That is, the second attachment member 33 extends outward striding over the attachment frame 13 from the inner side to the outer side in the machine width direction, and is attached to the first attachment member 30.

The second lateral plate portion 33*b* is positioned below the first lateral plate portion 33*a* and on the left side (on the machine inward side). The second lateral plate portion 33*b* is arranged on the machine inward side of the attachment frame 13 (specifically, on the left side of the intermediate portion 13*b* of the right frame 13R).

As shown in FIG. 8, the second lateral plate portion 33*b* extends in a direction separating away from the attachment frame 13 toward the machine inward side. One surface (the upper surface) of the second lateral plate portion 33*b* faces upward, and the other surface (the lower surface) faces downward.

The second control valve 25 is attached to the one surface of the second lateral plate portion 33*b* by a bolt B4 (see FIG. 5). In this manner, the second control valve 25 is fixed to the second attachment member 33.

In particular, as shown in FIG. 10, a through hole 33*g* is formed in the second lateral plate portion 33*b*, and the second control valve 25 is fixed to the second attachment member 33 by the bolt B4 (see FIG. 5) inserted through the through hole 33*g*. In addition, a second attachment hole 33*f*1 for attachment of a second cover 42 described later is formed in the second lateral plate portion 33*b*.

As described above, the second control valve 25 is fixed to the second attachment member 33, the second attachment member 33 is attached to the first attachment member 30, and the first attachment member 30 is attached to the attachment frame 13. In this manner, the second control valve 25 is attached to the attachment frame 13 with the first attachment member 30 and the second attachment member 33.

As shown in FIG. 10, the first vertical plate portion 33*c* couples the first lateral plate portion 33*a* and the second lateral plate portion 33*b* to each other. The upper end portion of the first vertical plate portion 33*c* is connected to the left end portion of the first lateral plate portion 33*a*. The lower end portion of the first vertical plate portion 33*c* is connected to the right end portion of the second lateral plate portion 33*b*.

The first vertical plate portion 33*c* is arranged on the machine inward side of the attachment frame 13 (specifically, on the left side of the intermediate portion 13*b* of the right frame 13 R), and extends in the vertical direction. One surface (the left surface) of the first vertical plate portion 33*c* faces leftward, and the other surface (the right surface) faces rightward.

As shown in FIG. 10, the second vertical plate portion 33*d* is connected to the left end portion of the second lateral plate portion 33*b*, and extends upward from the left end portion. The second vertical plate portion 33*d* faces the first vertical plate portion 33*c* and is arranged parallel to the first vertical plate portion 33*c*. The second vertical plate portion 33*d* is positioned on the left side of the first vertical plate portion 33*c* (on the inner side of the vehicle body).

The second vertical plate portion 33*d* is arranged on the machine inward side of the attachment frame 13 (specifically, on the left side of the intermediate portion 13*b* of the right frame 13R), and extends in the vertical direction. A second attachment hole 33*f*2 for attachment of a second cover 42 described below is formed in the second vertical plate portion 33*d*.

<First Cover and Second Cover>

Figure 6:
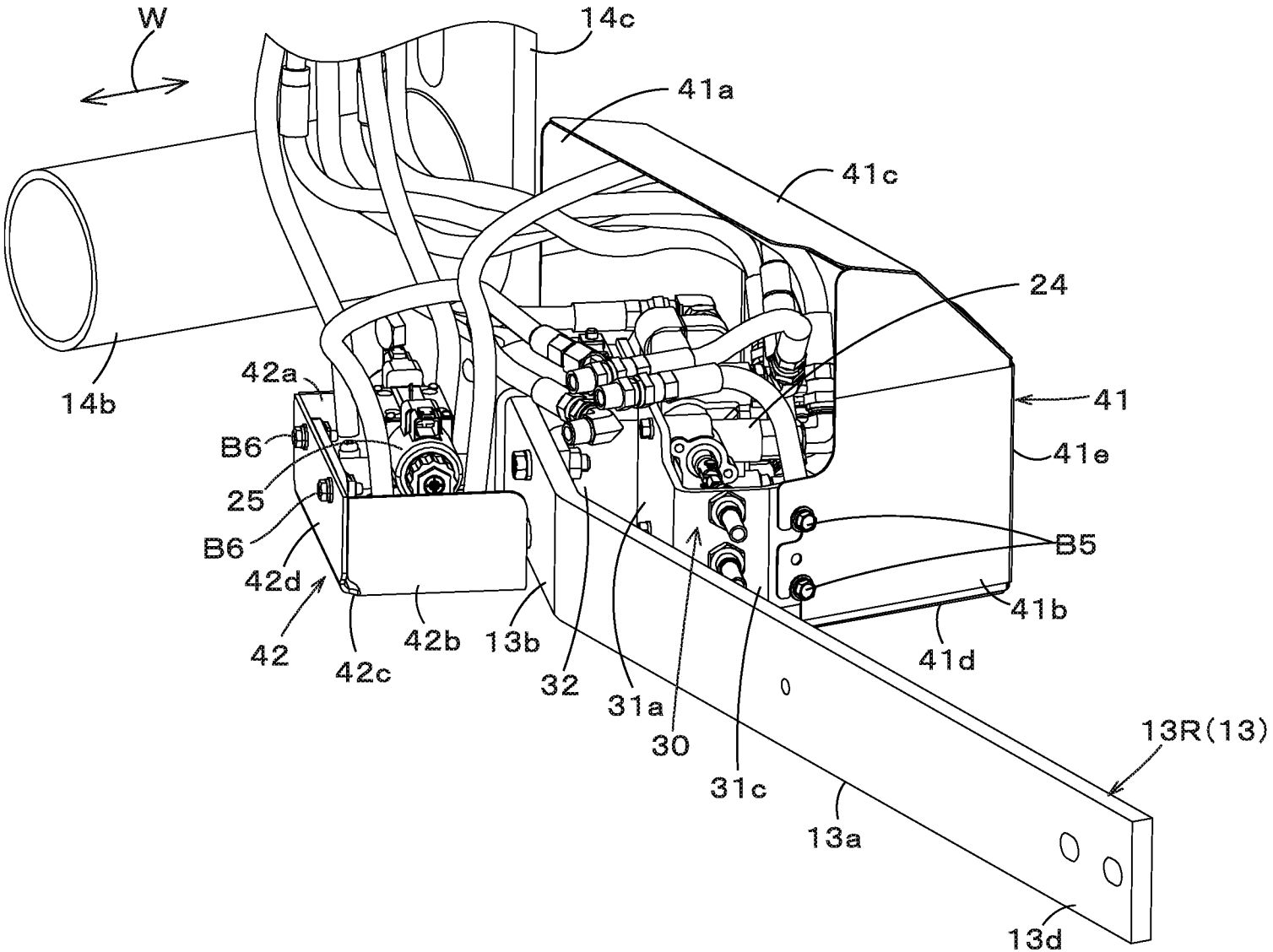
FIG. 6 is a view illustrating the attachment frame, the part of support body, the first control valve, the second control valve, and the like seen from a left-backward side according to the embodiment.
Figure 7:
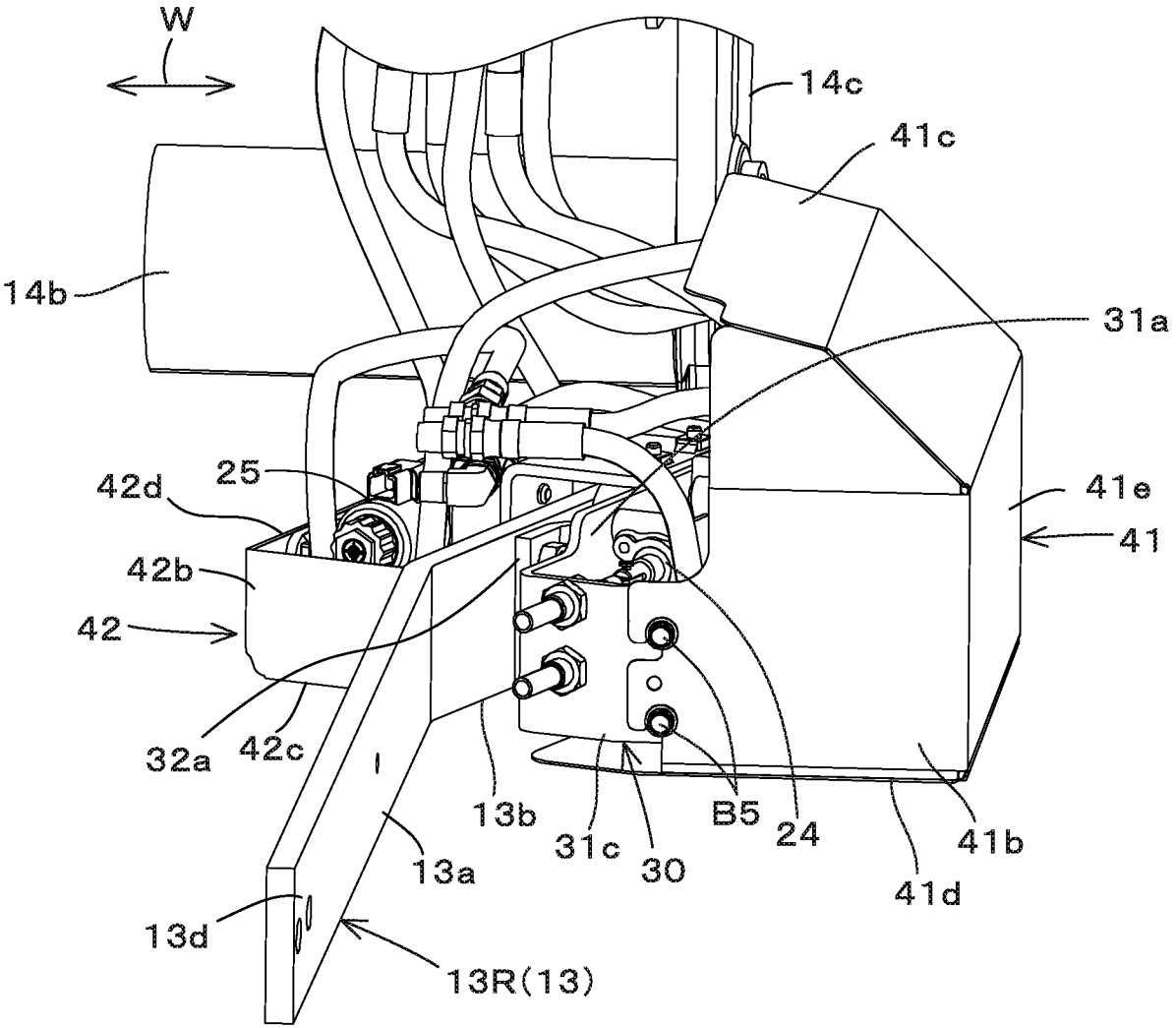
FIG. 7 is a view illustrating the attachment frame, the part of support body, the first control valve, the second control valve, and the like seen from a right-backward side according to the embodiment.

As shown in FIG. 6 and FIG. 7, the front loader 12 includes a first cover 41 and a second cover 42. The first cover 41 is a cover configured to cover the first control valve 24. The second cover 42 is a cover configured to cover the second control valve 25.

The first cover 41 is attached to the first attachment member 30. The first cover 41 has a first front cover plate 41*a*, a first rear cover plate 41*b*, a first upper cover plate 41*c*, a first lower cover plate 41*d*, and a right cover plate 41*e*. The first cover 41 is schematically formed in a box shape in which the left side (the side of the attachment frame 13) is opened.

The first front cover plate 41*a* is attached to the first attachment hole 33*b*1 (see FIG. 10) of the front plate portion 31*b* of the first attachment member 30. The first rear cover plate 41*b* is attached to the first attachment hole 33*c*1 (see FIG. 10) of the rear plate portion 31*c* of the first attachment member 30.

The first front cover plate 41*a* is attached to the first attachment member 30 by the bolts and nuts. The first rear cover plate 41*b* is also attached to the first attachment member 30 by the bolts B5 (see FIG. 6 and FIG. 7) and the nuts.

In a state in which the first cover 41 is attached to the first attachment member 30, the first front cover plate 41*a* covers the front of the first control valve 24. The first rear cover plate 41*b* covers the rear of the first control valve 24. The first upper cover plate 41*c* covers the upper side of the first control valve 24.

The first lower cover plate 41*d* covers the lower side of the first control valve 24. The right cover plate 41*e* covers the right side of the first control valve 24. In this manner, the first cover 41 covers the front side, the rear side, the upper side, the lower side, the right side (the machine outward side) of the first control valve 24.

In this manner, by covering the first control valve 24 with the first cover 41, it is possible to protect the first control valve 24 from an external impact, the rainfall, the snowfall and the like.

The second cover 42 is attached to the second attachment member 33. As shown in FIG. 6 and FIG. 7, the second cover 42 has a second front cover plate 42*a*, a second rear cover plate 42*b*, a second lower cover plate 42*c*, and a second left cover plate 42*d*. The second cover 42 is schematically formed in a box shape with the right side (the attachment frame 13 side) and the upper side opened.

The second left cover plate 42*d* is attached to the second attachment hole 33*f*2 (see FIG. 10) of the second vertical plate portion 33*d* of the second attachment member 33. The second lower cover plate 42*c* is attached to the second attachment hole 33*f*1 (see FIG. 10) of the second lateral plate portion 33*b* of the second attachment member 33.

The second left cover plate 42*d* is attached to the second attachment member 33 by the bolts B6 (see FIG. 6) and the nuts. The second lower cover plate 42*c* is also attached to the second attachment member 33 by the bolts and the nuts.

In a state in which the second cover 42 is attached to the second attachment member 33, the second front cover plate 42*a* covers the front side of the second control valve 25. The second rear cover plate 42*b* covers the rear side of the second control valve 25. The second lower cover plate 42*c* covers the lower side of the second control valve 25. The second left cover plate 42*d* covers the left side of the second control valve 25.

In this manner, the second cover 42 covers the front side, the rear side, the lower side, and the left side (the machine inward side) of the second control valve 25. In this manner, the second control valve 25 is covered with the second cover 42, so that it is possible to protect the second control valve 25 from the external impact, the rainfall, the snowfall and the like.

<Positional Relationship Between First Control Valve, Second Control Valve and Cabin>

Figure 12:
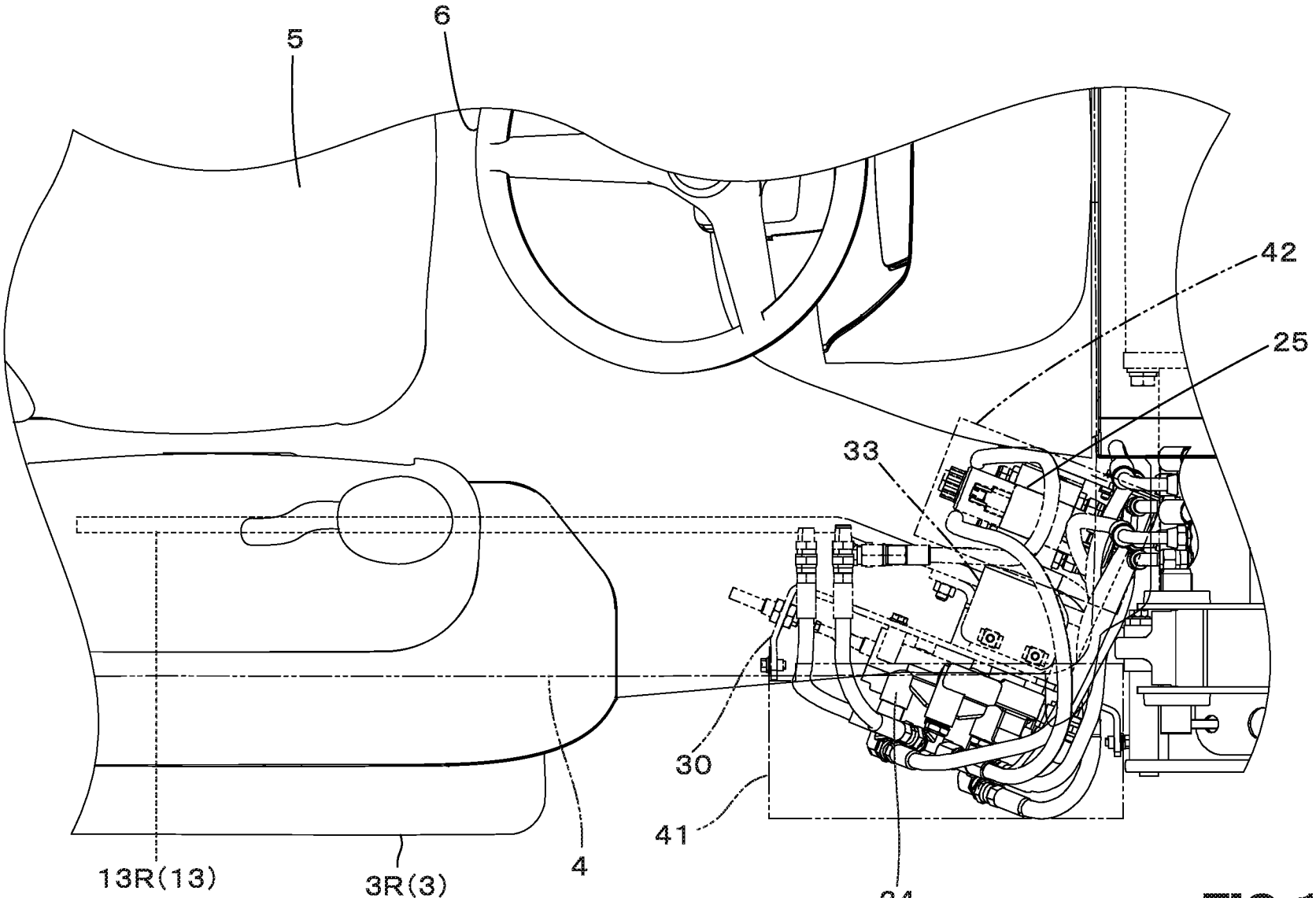
FIG. 12 is a partially-enlarged plan view of a work machine according to the embodiment, which enlarges periphery of the first control valve and the second control valve.

As shown in FIG. 12 to FIG. 14, the first control valve 24 and the second control valve 25 are arranged below the cabin 4 of the tractor 1. More specifically, as shown in FIG. 15, the first control valve 24 and the second control valve 25 are arranged below the lower frame 4*b* constituting the lower frame of the cabin 4 (the lower frame of the entrance opening 4*a*).

As shown in FIG. 12 and FIG. 13, the upper portions of the first control valve 24 and the second control valve 25 are covered with a cabin 4. It is preferable that the upper portions of the first control valve 24 and the second control valve 25 are entirely covered with the cabin 4. However, it is allowable that at least a part of the upper portions thereof is covered with the cabin 4. In the case of the present embodiment, at least a part of the first control valve 24 is covered with the cabin 4.

The upper portion of the second control valve 25 is entirely covered with a cabin 4. In other words, at least a part (a whole or a part) of the first control valve 24 is arranged on the machine inward side from the end portion on the machine outward side of the cabin 4. The second control valve 25 is arranged entirely on the machine inward side from the end portion on the machine outward side of the cabin 4.

In addition, at least a part (a whole or a part) of the first control valve 24 and the second control valve 25 is arranged between the front end portion and the rear end portion of the cabin 4 in the front-rear direction.

In this manner, the cabin 4 can prevent the first control valve 24 and the second control valve 25 from being hit by the earth and sand, the rainwater, the snow, and the like. In particular, accumulation of the snow on the first control valve 24 and the second control valve 25 can be prevented in using the tractor 1 in a cold district, and the failure of the first control valve 24 and the second control valve 25 caused by the snowfall can be prevented.

<Effect>

Hereinafter, effects of the front loader 12 and the work machine 1 according to the above-described embodiment will be described below.

The front loader 12 includes the boom 15 to which the bucket 16 or the working implement other than the bucket 16 is attached, the boom cylinder 17 to move the boom 15, the first control valve 24 to supply the operation fluid to the boom cylinder 17, the supporting member 14 supporting the boom 15 on the front portion of the vehicle body 2 of the work machine 1, the attachment frame 13 extending backward from the supporting member 14, the attachment frame 13 being attached to a side portion of the vehicle body 2, and the second control valve 25 to supply the operation fluid to the working implement, the second control valve 25 being attached to the attachment frame 13.

According to that configuration, the second control valve 25, which controls the supply of the operation fluid flowing to the working implement other than the bucket 16, is attached to the attachment frame 13 attached to the side portion of the vehicle body 2 of the work machine 1 and extended backward from the support body 14 supporting the boom 15. Thus, it is possible to prevent the earth and sand and the loads from falling on the second control valve 25 and to prevent the rainwater and the snow from falling on the second control valve 25 during operation. In this manner, it is possible to prevent the earth and sand, the rainwater, the snow and the like from affecting the function of the second control valve 25.

In addition, the first control valve 24 is attached to the attachment frame 13.

According to that configuration, not only the second control valve 25 but also the first control valve 24 are attached to the attachment frame 13. Thus, it is possible to prevent the earth and sand and the loads from falling on the first control valve 24 and the second control valve 25 and to prevent the rainwater and the snow from falling on the first control valve 24 and the second control valve 25 during operation. In this manner, it is possible to prevent the earth and sand, the rainwater, the snow and the like from affecting the functions of the first control valve 24 and the second control valve 25.

The first control valve 24 and the second valve 25 are arranged on both sides of the attachment frame 13 in a width direction of the vehicle body 2.

According to that configuration, the first control valve 24 and the second control valve 25 can be arranged close to each other. Thus, the first control valve 24 and the second control valve 25 can be collectively and compactly arranged, and the installation space for the first control valve 24 and the second control valve 25 can be easily secured.

In addition, it is possible to easily connect the hydraulic hoses to the first control valve 24 and the second control valve 25.

In addition, the first control valve 24 is arranged outward from the attachment frame 13 in the machine width direction, and the second control valve 25 is arranged inward from the attachment frame 13 in the machine width direction.

With this configuration, the maintenance of the first control valve 24 can be easily performed from the outside of the vehicle body. In addition, it is possible to effectively prevent the earth and sand and the loads from falling on the second control valve 25 and to effectively prevent the rainwater or the snow from falling on the second control valve 25 during the working.

In addition, the front loader 12 includes the first attachment member 30 to which the first control valve 24 is fixed, the first attachment member 30 being attached to the attachment frame 13, and the second attachment member 30 to which the second control valve 25 is fixed, the second attachment member 30 being attached to the first attachment member 30.

According to that configuration, the second control valve 25 is fixed to the second attachment member 33 attached to the first attachment member 30. Thus, it is possible to reliably attach the second control valve 25 to the attachment frame 13 even when it is difficult to directly attach the second attachment member 33 to the attachment frame 13 because of shortage of space or the like.

In addition, the first attachment member 30 is arranged outside from the attachment frame 13 in the width direction, and the second attachment member 33 extends striding over the attachment frame 13 from the inside from the outside in the width direction and is attached to the first attachment member 30.

According to that configuration, by attaching the second attachment member 33 to the first attachment member 30 so as to straddle the attachment frame 13, the second attachment member 33 can be attached to the first attachment member 30 without being hindered by the attachment frame 13.

In addition, the attachment frame 13 has the front attachment portion 13*d* and the rear attachment portion 13*e*, the front attachment portion 13*d* is attached to the support body 14, and the rear attachment portion 13*e* is attached to the rear axle case 11 provided on the vehicle body 2.

According to that configuration, the attachment frame 13 can be reliably attached to the rear portion of the vehicle body 2, and the support body 14 can be attached to the rear portion of the vehicle body 2 with the attachment frame 13.

In addition, as the rear attachment portion 13*e* of the attachment frame 13 is attached to the rear axle case 11, it is possible to suppress that the vibration generated in the transmission case 8 is transmitted to the attachment frame 13 in comparison with the case where the attachment frame 13 is directly attached to the transmission case 8. In this manner, it is possible to suppress that the vibration of the attachment frame 13 affects the first control valve 24 and the second control valve 25.

In addition, the front loader 12 includes the first cover 41 attached to the first attachment member 30 and covering the first control valve 24.

According to that configuration, the first control valve 24 is covered with the first cover 41. Thus, it is possible to effectively prevent the earth and sand, the rainwater, the snow, and the like from affecting the first control valve 24.

In addition, the front loader 12 includes the second cover 42 attached to the second attachment member 33 and covering the second control valve 25.

According to that configuration, the second control valve 25 is covered with the second cover 42. Thus, it is possible to effectively prevent the earth and sand, the rainwater, the snow, and the like from affecting the second control valve 25.

The work machine 1 includes the front loader 12, and the vehicle body 4 supporting the front loader 12.

According to that configuration, it is possible to provide the work machine 1 provided with the front loader 12 capable of preventing the earth and sand, the rainwater, the snow, and the like from affecting the functions of the first control valve 24 and the second control valve 25.

In addition, the work machine 1 includes the cabin 4 mounted on the vehicle body 2, and the first control valve 24 and the second control valve 25 are arranged below the cabin 4.

According to that configuration, the cabin 4 can prevent that the earth and sand, the rain water, the snow, and the like fall on the first control valve 24 and the second control valve 25.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A front loader comprising:

a boom to which a bucket or a working implement other than the bucket is attached;

a boom cylinder to move the boom;

a first control valve to supply an operation fluid to the boom cylinder;

a supporting member supporting the boom on a front portion of a vehicle body of a working machine;

an attachment frame extending backward from the supporting member, the attachment frame being attached to a side portion of the vehicle body;

a second control valve to supply the operation fluid to the working implement, the second control valve being attached to the attachment frame;

a first attachment member on which the first control valve is fixed, the first attachment member being attached to the attachment frame; and a second attachment member on which the second control valve is fixed, the second attachment member being attached to the first attachment member;

wherein the first attachment member is arranged outside from the attachment frame in the width direction, and wherein the second attachment member extends striding over the attachment frame from the inside from the outside in the width direction and is attached to the first attachment member.

2. The front loader according to claim 1, wherein the first control valve and the second valve are arranged on both sides of the attachment frame in a width direction of the vehicle body.

3. The front loader according to claim 2, wherein the first control valve is arranged outside from the attachment frame in the width direction, and wherein the second control valve is arranged inside from the attachment frame in the width direction.

4. The front loader according to claim 1, wherein the attachment frame includes a front attachment portion attached to the supporting member, and a rear attachment portion attached to a rear axle case provided on the vehicle body.

5. The front loader according to claim 1, comprising a first cover attached to the first attachment member, the first cover covering the first control valve.

6. The front loader according to claim 1, comprising a second cover attached to the second attachment member, the second cover covering the second control valve.

7. A working machine comprising:

a front loader according to claim 1; and the vehicle body supporting the front loader.

8. The working machine according to claim 7, comprising a cabin mounted on the vehicle body, wherein the first control valve and the second control valve are arranged below the cabin.

* * * * *